US006305953B1

(12) United States Patent
Shi et al.

(10) Patent No.: US 6,305,953 B1
(45) Date of Patent: Oct. 23, 2001

(54) ELECTRICAL CONNECTOR WITH IMPROVED GROUNDING STRUCTURE FOR SHIELDING SHELL THEREOF

(75) Inventors: GuangXing Shi; Weiya Cheng; Qiang Chen, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/751,821

(22) Filed: Dec. 28, 2000

(30) Foreign Application Priority Data

Oct. 24, 2000 (TW) ..... 89218471 U

(51) Int. Cl.[7] ..... H01R 13/652

(52) U.S. Cl. ..... 439/108; 439/607; 439/573

(58) Field of Search ..... 439/92, 108, 607–609, 439/564, 560, 569, 570, 571, 567, 573

(56) References Cited

U.S. PATENT DOCUMENTS 4,968,261 * 11/1990 Mizunuma ..... 439/108
5,024,607 * 6/1991 Kachlic ..... 439/567
5,344,342 * 9/1994 Briones ..... 439/108
5,727,970 * 3/1998 Kognchi et al. ..... 439/607

* cited by examiner

*Primary Examiner*—Hien Vu
(74) *Attorney, Agent, or Firm*—Wei Te Chung

(57) ABSTRACT

An electrical connector includes a dielectric housing (1), a terminal module (2), a shielding shell (3), a pair of grounding plates (15), a pair of board locks (14) and a pair of rivets (13). The terminal module (2) is attached to the dielectric housing (1) so that a plurality of terminals (4) extends through a mating projection (8) of the housing (1). The shielding shell (3) encloses the mating projection (8). The board locks (14) and grounding plates (15) are fixed to both ends of the housing (1) by the rivets (13). A resilient finger (152) of each grounding plate (15) contacts the shielding shell (3). Engaging legs (142) of the board locks (14) are adapted to mount to a printed circuit board and connect with a grounding trace of the printed circuit board. Thus the shielding shell (3) is electrically grounded to the grounding traces via the grounding plates (15) and board locks (14).

4 Claims, 8 Drawing Sheets

ELECTRICAL CONNECTOR WITH IMPROVED GROUNDING STRUCTURE FOR SHIELDING SHELL THEREOF

BACKGROUND OF THE INVENTION

1. Field of the Invention

The present invention relates to an electrical connector, and particularly to an electrical connector having an improved grounding structure for a shielding shell thereof.

2. Brief Description of the Prior Art

In the electronics industry, an electrical connector is usually mounted on a printed circuit board (PCB) for electrically connecting an external device to a PCB. The electrical connector, regardless of whether it is a plug or a receptacle connector, has a dielectric housing receiving a plurality of contacts therein. The electrical connector often has a shielding shell, which must be grounded to properly shield the contacts therein and to dissipate electrostatic charges accumulated on the shell to ground.

Referring to FIG. 1, U.S. Pat. No. 4,943,244 discloses a conventional electrical connector comprising a shielding shell 1', a housing 2', a board lock member 3' and terminals 4'. The housing 2' has a base 21' and a mating portion 20' at the front of the base 21'. A plurality of terminal receiving passages 22' are defined through the mating portion 20' and base 21' for receiving the electrical terminals 4'. The shell 1' isassembled to the housing 2' in a direction indicated by an arrow A and a shroud 10' of the shell 1' surrounds the mating portion 20'. At the same time, a pair of ground straps 11' projecting rearwardly from a bottom edge of the shell 1' engages a bottom of the base 21'. A board lock member 3' is mounted to a lateral flange of the housing 2' in a direction indicated by an arrow B to a position at which a locking tab 31' fits into a corresponding recess 23' in the flange. The ground strap 11' is then engaged with board lock member 3', whereby electrostatic charges accumulated on the shell 1' can be transmitted to ground on a printed circuit board to which locking legs 30' of the board lock members 3' are connected.

However, for this conventional connector, the shell 1' and the ground strap 11' are integrally stamped, which results in a lot of wasted material during the manufacturing process. In addition, when the connector requires a high profile, two towers are formed on lateral sides of the housing to increase the height of the connector. For such high profile connectors, the ground straps must downwardly extend a long distance relative to the shroud, which further increases the amount of wasted material during manufacturing of the shielding shell. Furthermore, when the ground straps extend a relatively long distance from the shroud, they become very flexible and thus become difficult to correctly assemble to the housing.

Hence, an improved electrical connector is required to overcome the disadvantages of the prior art.

BRIEF SUMMARY OF THE INVENTION

An object of the present invention is to provide a high profile electrical connector having a shielding shell which can be effectively connected to round in an economical way.

To achieve the above-mentioned object, an electrical connector in accordance with the present invention comprises a dielectric housing, a terminal module, a shielding shell, a pair of grounding plates, a pair of board locks and a pair of rivets. The dielectric housing has a base and a mating projection. The terminal module attaches to the base such that the base and the mating projection receive a plurality of terminals therein. Two towers downwardly extend from two lateral sides of the housing. The shielding shell encloses the mating projection of the housing. One board lock mounts in each of the towers of the housing and is adapted to mount the connector on a printed circuit board and to connect with a grounding trace of the printed circuit board. Each grounding plate electrically connects a corresponding board lock with the shielding shell.

Other objects, advantages and novel features of the present invention will become more apparent from the following detailed description of the present embodiment when taken in conjunction with the accompanying drawings.

DETAILED DESCRIPTION OF THE INVENTION

Figure 1:
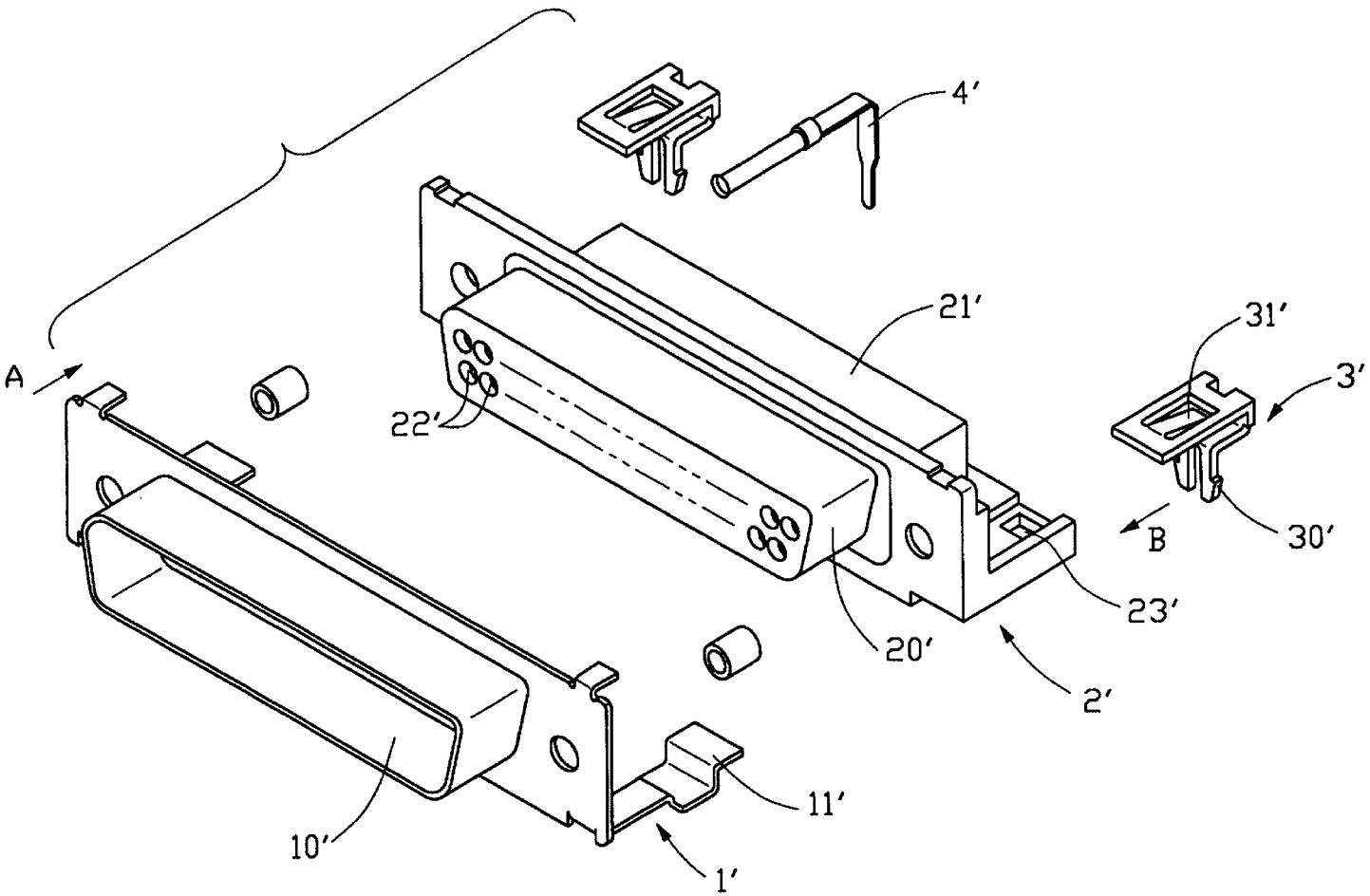
FIG. 1 (PRIOR ART)
FIG. 1 is an exploded view of a conventional electrical connector.
Figure 2:
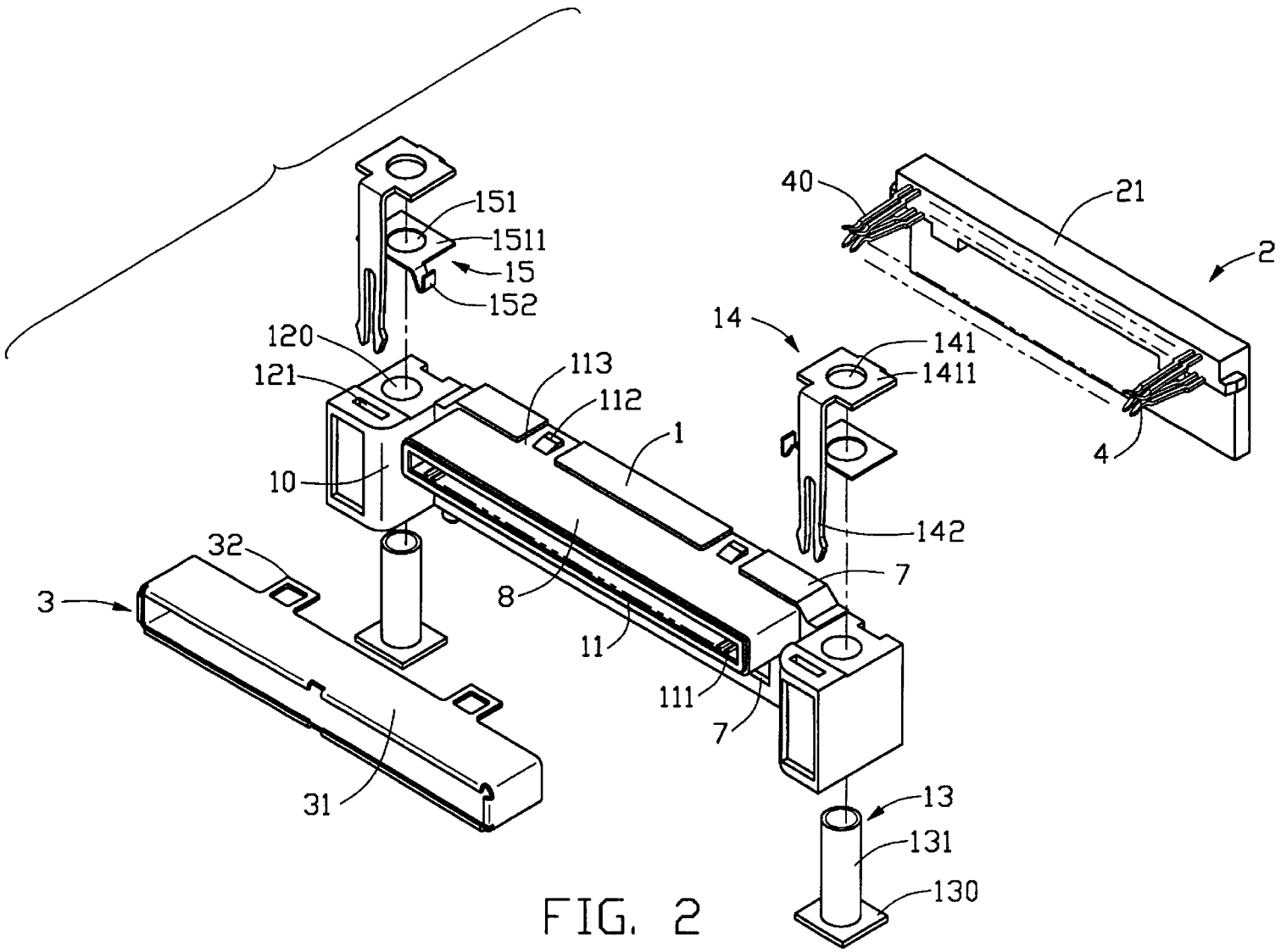
FIG. 2 is an exploded view of an electrical connector of the present invention.
Figure 3:
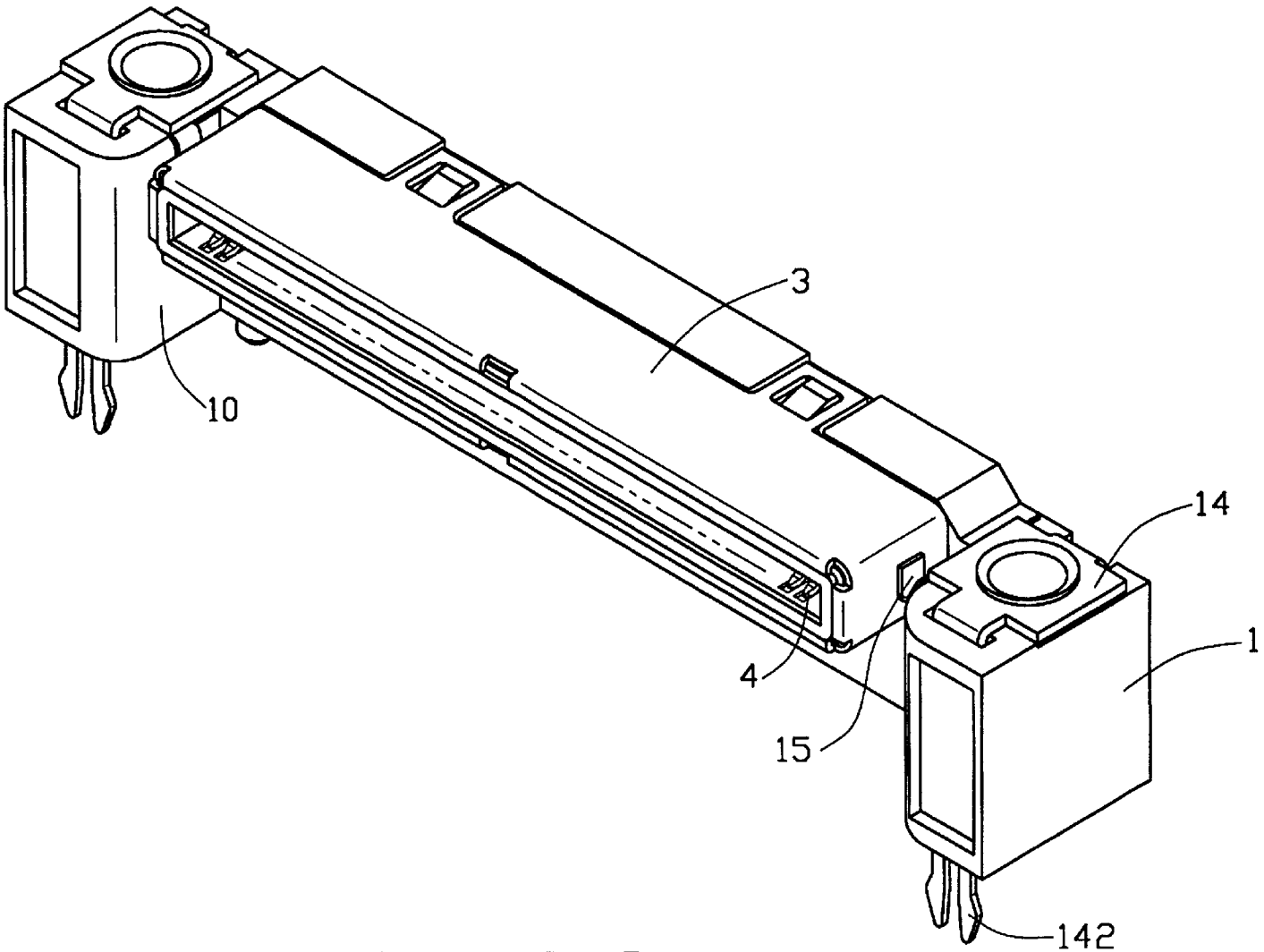
FIG. 3 is a perspective view of the electrical connector of the present invention.

Referring to FIG. 2 and FIG. 3, an electrical connector of the present invention comprises a dielectric housing 1, a terminal module 2, a shielding shell 3, a pair of grounding plates 15, a pair of board locks 14 and a pair of rivets 13.

The housing 1 has a high profile structure and forms a base 7 extending its full height, and a mating projection 8 providing forwardly from an upper portion of the base 7. A slot 11 is defined horizontally through the mating projection 8 and the base 7 of the housing 1. A plurality of terminal receiving passageways 111 is formed in inner upper and lower surfaces of the mating projection 8 and the base 7 and in communication with the slot 11. A pair of recesses 101 is defined at two lateral sides of the slot 11 (FIG. 5) and in communication with the slot 11. A pair of projection 112 is formed on a top surface 1 13 of the base 7. Each of two sides of the housing 1 forms a tower 10 downwardly extending a distance relative to the slot 11. A round hole 120 and a rectangular slit 121 are defined vertically through each of towers 10 with the round hole 120 located to a rear of the rectangular slit 121.

The terminal module 2 consists of a vertical board 21 and a plurality of terminals 4 assembled in the board 21 by insert molding. Each terminal 4 has a contact portion 40 horizontally extending to a front of an upper portion of the board 21 for mating with a corresponding contact of a complementary connector (not shown). A tail portion 41 (better seen in FIG.5) horizontally rearwardly extends at a bottom of the board 21 for soldering to a printed circuit board (not shown) by surface mounting technology. An ear 210 is formed on each of two sides of the vertical board 21.

The shell 3 has a hollow shroud 31 and a plurality of latching tabs 32 project rearwardly from the shroud 31.

The rivets 13 are used to fix the board locks 14 and the grounding plates 15 to the towers 10. The rivets 13 each consist of a rectangular flat base 130 and a tubular member 131 extending upwardly from the base 130. The board locks 14 each include a flake 1411 which defines a central hole 141 therein and engaging legs 142 perpendicularly and downwardly extending from the flake 1411. The grounding plate 15 includes a flat body 1511 defining a central hole 151 therein and a resilient finger 152 extending from a side of the flat body 1511.

Figure 4:
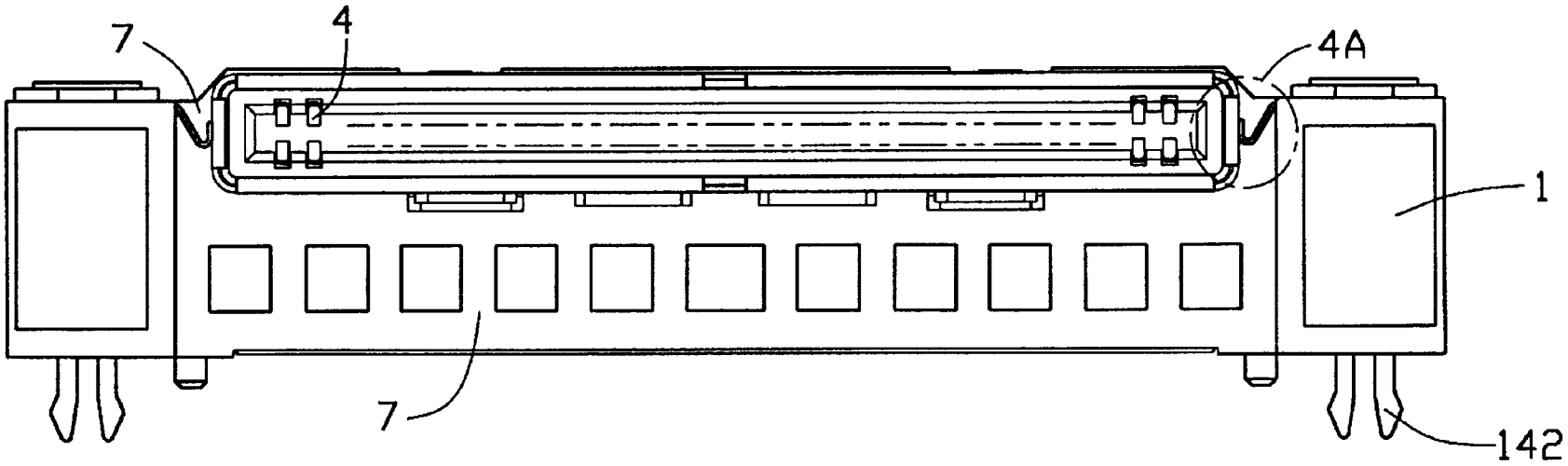
FIG. 4 is a front view of the electrical connector of the present invention.
Figure 4A:
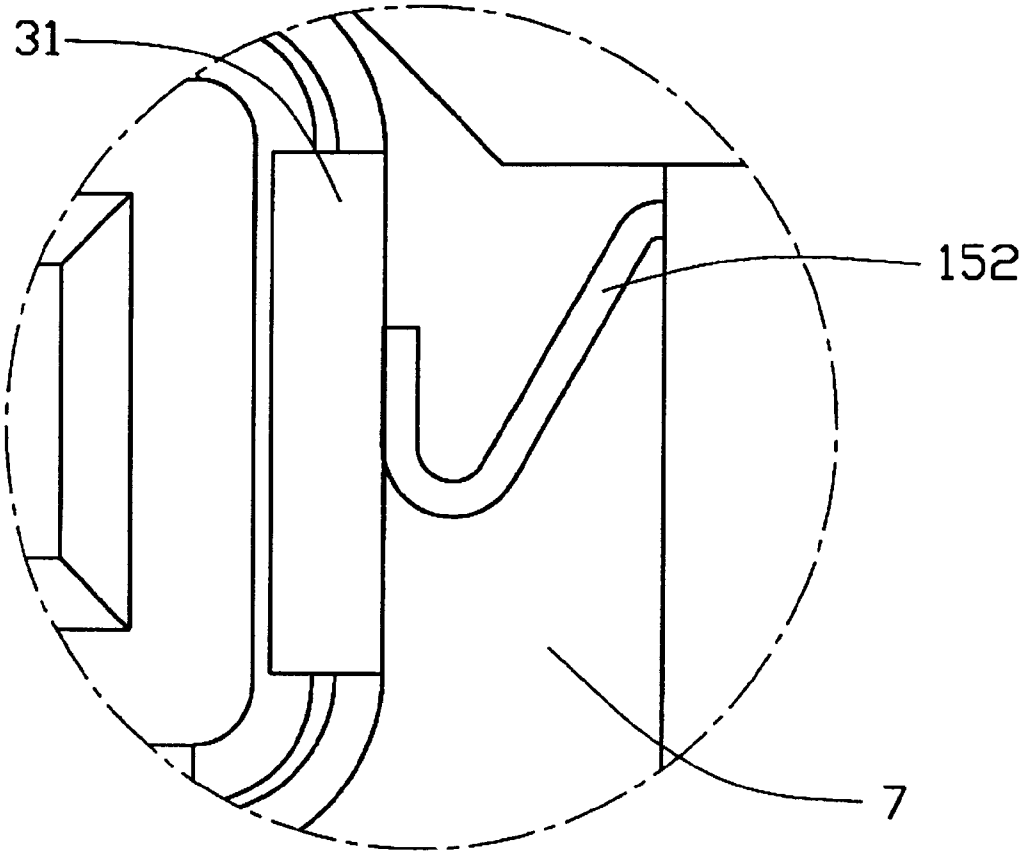
FIG. 4A is a partially enlarged view of a part of FIG. 4 indicated by a circle in phantom lines.
Figure 5:
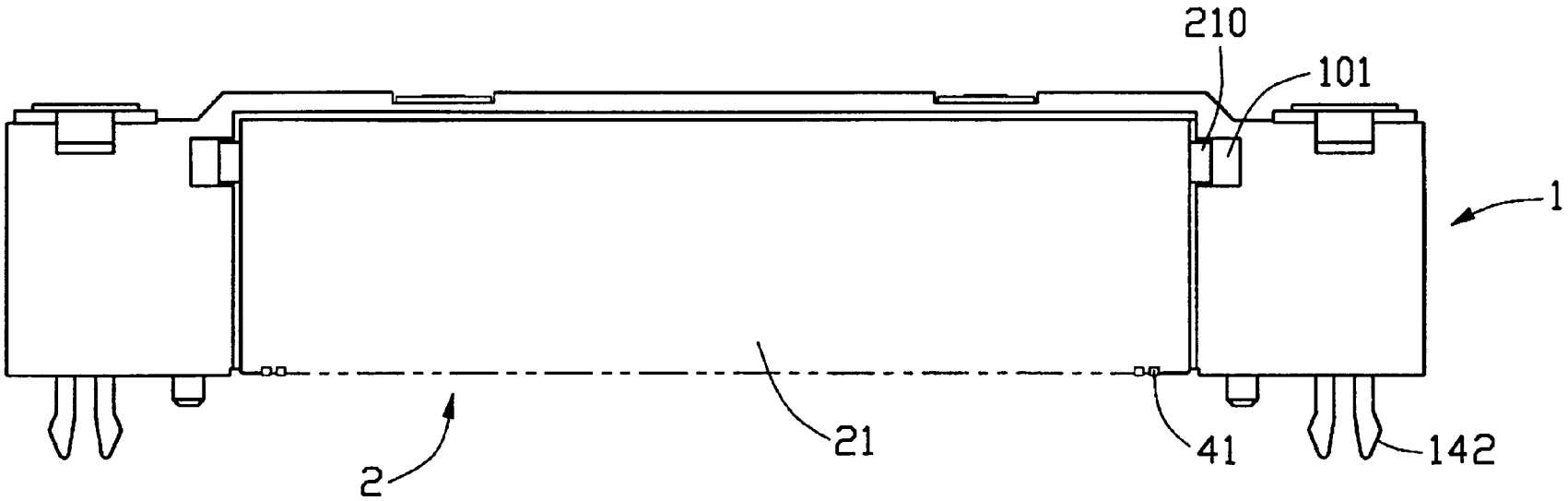
FIG. 5 is a rear view of the electrical connector of the present invention.

In assembly, also referring to FIGS. 3–5, the terminal module 2 is attached to the housing 1 from a rear side of the housing 1, the contact portions 40 of the terminals 4 being inserted into the slot 11 and being received in corresponding terminal receiving passageways 111. The ears 210 of the terminal module 2 are received in the recesses 101 of the housing 1 to secure the terminal module 2 in the housing 1. The shielding shell 3 is then assembled to the housing 1 by engaging the latching tabs 32 with the protrusions 112 on the top surface 113 of the base 7, The shroud 31 thereby encloses the mating projection 8 to shield the contact portions 40 of the terminals 4. The rivets 13 are assembled to the towers 10 of the housing 1 by extending the tubular members 131 into the round holes 120, respectively, from a bottom of the towers 10. Afterwards, the grounding plates 15 are assembled to the rivets 13 and the towers 10 by extending the tubular members 131 through the central holes 151, so that free ends of the resilient fingers 152 resiliently abut against two lateral sides of the shroud 31. The board locks 14 are then assembled to the rivets 13, the grounding plates 15 and the towers 10 by inserting the engaging legs 142 of the board locks 14 downwardly through the rectangular slits 121 from a top of the towers 10. The tubular members 131 extend through the central holes 141 of the board locks 14. The flat bodies 1511 of the grounding plates 15 are thereby sandwiched between the top of the towers 10 and the flakes 1411 of the board locks 14. Finally, a top end of the tubular members 131 is subjected to a riveting operation, thereby fixedly connecting the rivets 13,the board locks 14 and the grounding plates 15 to the towers 10 of the housing 1.

Figure 6:
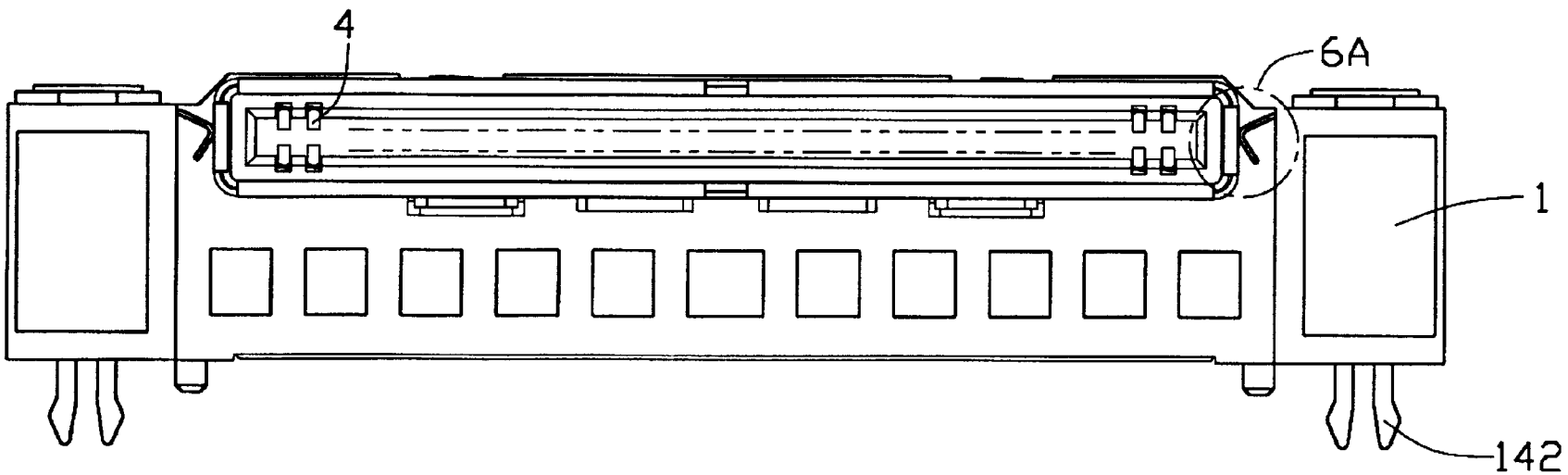
FIG. 6 is view similar to FIG. 4 showing an electrical connector in accordance with a second embodiment of the present invention.
Figure 6A:
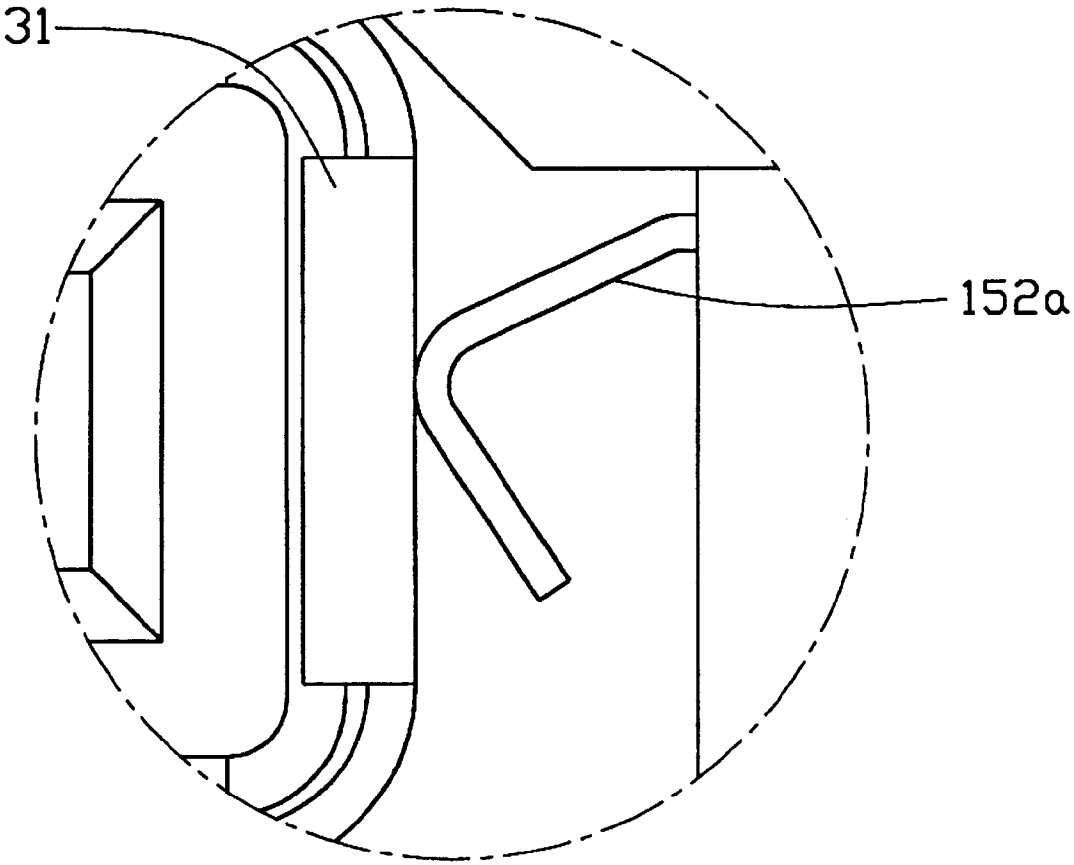
FIG. 6A is a partially enlarged view of FIG. 6 indicated by a circle in phantom lines.

FIGS. 6 and 6A show a second embodiment of the present invention, which is substantially the same as the first embodiment except for the configuration of the resilient fingers. In the second embodiment, the fingers 152*a* are configured so that a curved angle of the finger 152*a,* rather than a free end of the finger 152 as in the first embodiment resiliently abut against a corresponding side of the shroud 31 of the shielding shell 3.

When the connector is mounted to a printed circuit board, electrostatic charges accumulated on the shielding shell 3 can be transmitted to ground by the grounding plates 15 and the board locks 14 since the engaging legs 142 of the board locks 14 are soldered to grounding traces on the printed circuit board, and the shroud 31 of the shielding shell 3, the grounding plates 15 and the board locks 14 are electrically connected together.

From the above disclosures, it is clear that the present invention provides an effective and economical apparatus for grounding a shielding shell of a high profile connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a dielectric housing having a base, a mating projection extending forward from the base, and two towers formed at two lateral sides of the base;

a plurality of terminals being received in the base and protruding into the mating projection;

a shielding shell enclosing the mating projection of the housing;

a board lock mounted in each of the towers of the housing and adapted for mounting the connector on a printed circuit board and for electrically connecting with a grounding trace of the printed circuit board;

at least a grounding plate positioned on a top of a corresponding tower and electrically connecting with a corresponding board lock and with the shielding shell; and at least a rivet extending through a corresponding tower, the grounding plate and a flake of a corresponding board lock to fixedly connect the grounding plate, the board lock and the tower together, with the grounding plate sandwiched between the tower and the flake of the board lock; wherein the grounding plate has a resilient finger with a downwardly curved configuration and a free end of the resilient finger resiliently abuts against the shielding shell.

2. The electrical connector as claimed in claim 1, wherein the board locks each have engaging legs downwardly extending from a side of the flake and through a slit defined in the corresponding tower, said engaging legs being adapted for engaging with the printed board and being soldered to the grounding traces thereof.

3. The electrical connector as claimed in claim 2, further including a terminal module, the terminal module comprising a board, the board being attached to a rear side of the housing, the terminals being inserted molded in the board, each terminal having a contact portion horizontally extending into a slot defined in the housing, and a tail portion horizontally extending from a bottom of the board.

4. An electrical connector comprising:

a dielectric housing having a base, a mating projection extending forwardly from the base, and a pair of towers located at two lateral sides of the base;

a plurality of terminals being received within the base and protruding into the mating projection;

a shield shell substantially enclosing the mating projection of the housing;

a board lock mounted on to each of said towers for mounting and grounding the connector on a printed circuit board;

a grounding plate secured to the board lock; wherein said grounding plate extends laterally and inwardly to mechanically and electrically contact the shield shell; wherein the board lock is fastened to the housing by a rivet which extends through the tower in a vertical direction along which engaging legs of the board lock extend, while the mating projection defines a horizontal mating direction perpendicular to said vertical direction.

* * * * *